US007523593B2

(12) United States Patent
Aoyagi et al.

(10) Patent No.: US 7,523,593 B2
(45) Date of Patent: Apr. 28, 2009

(54) SHEET PROCESSING DEVICE AND IMAGE FORMING DEVICE

(75) Inventors: Shigeo Aoyagi, Moriya (JP); Akinobu Nishikata, Kashiwa (JP); Takayuki Fujii, Toshima-ku (JP); Shigeru Kasahara, Arakawa-ku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/448,544

(22) Filed: Jun. 7, 2006

(65) Prior Publication Data

US 2006/0279035 A1 Dec. 14, 2006

(30) Foreign Application Priority Data

Jun. 14, 2005 (JP) ..... 2005-173396
Jun. 14, 2005 (JP) ..... 2005-173397

(51) Int. Cl.
*B65B 63/04* (2006.01)
*B65H 37/06* (2006.01)
*G03G 15/00* (2006.01)

(52) U.S. Cl. ..... 53/117; 53/120; 53/206; 270/37; 270/58.08; 399/408; 399/410

(58) Field of Classification Search ..... 53/120, 53/429, 117, 206; 399/407, 408, 410; 270/37, 270/58.08
See application file for complete search history.

(56) References Cited

U.S. PATENT DOCUMENTS 264,380 A * 9/1882 Waters ..... 53/120
541,318 A * 6/1895 Davies et al. ..... 53/120
868,258 A * 10/1907 Farnham ..... 53/120
870,501 A * 11/1907 Farnham ..... 53/120
1,152,794 A * 9/1915 Cox ..... 53/120
2,030,880 A * 2/1936 Kleineberg ..... 53/120
2,853,839 A * 9/1958 Herrmann ..... 53/429
3,053,024 A * 9/1962 Wexler ..... 53/120
3,161,000 A * 12/1964 Hannon et al. ..... 53/120
3,691,721 A * 9/1972 Hannon et al. ..... 53/120
4,021,993 A * 5/1977 Widmer ..... 53/120
4,773,202 A * 9/1988 Felts et al. ..... 53/429
5,029,429 A * 7/1991 Noma et al. ..... 53/120
5,547,175 A * 8/1996 Graushar et al. ..... 270/37
5,615,537 A * 4/1997 Vollenweider ..... 53/466
6,354,059 B1 * 3/2002 Yoshie et al. ..... 53/117

FOREIGN PATENT DOCUMENTS

JP 2001-058758 A 3/2001

* cited by examiner

*Primary Examiner*—Stephen F Gerrity
(74) *Attorney, Agent, or Firm*—Canon U.S.A., Inc. I.P. Division

(57) ABSTRACT

A sheet processing device is provided which is adapted to process bundles of sheets, each bundle defined by opposing first and second bundle edges, each bundle including a sealing sheet having a larger size than the sheets which form the bundle, the sealing sheet including a sealing portion which projects away from the second bundle edge. The device includes an abutting member adapted to abut against the first bundle edge; a folding unit adapted to fold the bundle between the first and second bundle edges; and a processing unit adapted to seal the bundle using the sealing portion of the sealing sheet, wherein the sealing portion is overlapped over the second and first bundle edges to form a seal.

12 Claims, 12 Drawing Sheets

SHEET PROCESSING DEVICE AND IMAGE FORMING DEVICE

BACKGROUND OF THE INVENTION

1. Field of the Invention

The present invention relates to a sheet processing device which can perform processing such as fastening and folding of a bundle of sheets which have images formed thereupon by a photocopier or printer. And in particular, the present invention relates to a sheet processing device wherein damage of the sheet bundle is minimized and the content of the sheet bundle cannot be easily viewed by a third party, and to an image forming device to which the sheet processing device is provided.

2. Description of the Related Art

Various sheet processing devices have been proposed which perform predetermined processing as to a sheet which has images formed thereupon by an image forming device such as a photocopier or printer. For example, a sheet processing device is known wherein the sheets discharged from the image forming device are stored temporarily and aligned, and combined processing is performed on the sheet bundle to both fasten it in the center and fold it in half.

With this sheet processing device, the sheets discharged from the image forming device are transported to an abutting portion, and by repeating this operation, the sheets are temporarily stored in the abutting portion. The sheets stored in the abutting portion are abutted against the abutting portion and are aligned. The aligned sheet bundle is stapled in approximately the middle thereof. Further, the stapled sheet bundle is folded in half so that the fastening location is the folding location. Thus, the sheet bundle which is folded in half is obtained as a product.

Recently, image forming devices which have the above-described sheet processing device have become adapted to be connected to networks and shared by multiple people. In such a case, each operator performs output operations at a remote location from the image forming device, and estimating the time for the output to finish, goes to retrieve the output object at the image forming device. In the case of an image forming device with such a network connection, when the image forming device is shared by multiple people, since each operator is in a remote location from the image forming device, the situation is that the content of such products can be easily viewed by other operators. Thus, in the event of outputting important information, shielding the information has become a problem, and continues to receive focus.

To solve this problem, in order to prevent a third party from viewing the content of the output object, technology has been proposed which performs stapling processing on the open side also of the output bundle which has been stapled. (See Japanese Patent Laid-Open No. 2001-58758). With the technology described in Japanese Patent Laid-Open No. 2001-58758, the open side of the sheet bundle is also fastened, and therefore in order to be able to browse the content of the sheet bundle, the staples on the open side of the sheet bundle must be removed.

However, the open side of the sheet bundle is also stapled, and therefore in order to not damage the sheet bundle, the staples on the open side of the sheet bundle need to be removed carefully. Further, even if the staples are removed from the open side without damaging the sheet bundle, staple holes remain on the open side in all of the sheets of the sheet bundle, and therefore, even if the information is shielded, the final sheet bundle obtained cannot be said to be in a favorable state.

SUMMARY OF THE INVENTION

Accordingly, the present invention provides for a way to minimize damage to a sheet bundle, and to prevent a third party from viewing the content of the sheet bundle.

According to an exemplary embodiment of the present invention, a sheet processing device is provided which is adapted to process bundles of sheets, each bundle defined by an opposing first and second bundle edges, each bundle including a sealing sheet having a larger size than the sheets forming the bundle, the sealing sheet including a sealing portion which projects away from one of the bundle edges. The device includes a folding unit adapted to fold the bundle between the first and second bundle edges; and a processing unit adapted to seal the bundle using the sealing portion of the sealing sheet. Also, according to another aspect of the present embodiment, the sheet processing device may further include an abutting member adapted to abut against the first bundle edge, wherein the sealing portion of the sealing sheet projects away from the second bundle edge, when the first bundle edge abuts against the abutting member.

According to an aspect of the present embodiment, the processing unit adheres the sealing portion to an outer surface of the sealing sheet proximate the first bundle edge. According to another aspect of the present embodiment, the sheet processing device may further include a controller configured to cause the device to selectively insert the sealing sheet into the bundle.

According to another aspect of the present embodiment, the sealing sheet is positioned on an outer side of the bundle. According to yet another aspect of the present embodiment, the sheet processing device may further include a sealing portion folding unit adapted to fold the sealing portion over the first and second bundle edges. Furthermore, according to another aspect of the present embodiment, a folding position of the sealing portion may be changed according to a thickness of the bundle to be sealed.

Additionally, according to another aspect of the embodiment, the sheet processing device may further include a fastening unit adapted to fasten together sheets forming the bundle, wherein the folding unit folds the bundle about a fastened portion of the bundle. Moreover, according to another aspect of the present invention, wherein the fastening unit is a middle fastening unit which fastens an approximate center of the bundle, wherein the folding unit is a half fold unit which is adapted to fold bundle in half about the fastened portion thereof.

According to another exemplary embodiment of the present invention, a sheet processing device is provide which is adapted to process bundles of sheets, each bundle defined by opposing first and second bundle edges, each bundle further including a sealing sheet having a larger size than the sheets forming the bundle, the sealing sheet including a first and second sealing portion which projects away from the first and second bundle edges, respectively. The device includes a folding unit adapted to fold a bundle between the first and second bundle edges; a processing unit adapted to seal the bundle using the first and second sealing portions. And according to another aspect of the present invention, the sheet processing device may further include a first abutting member adapted to abut against the sheets forming the bundle; and a second abutting member adapted to abut against the sealing sheet, wherein the first and second sealing portion of the sealing sheet projects away from the first and second bundle edges, respectively, when sheets forming the bundle abuts against the first abutting member and the sealing sheet abuts against the second abutting member.

According to an aspect of the present invention, the processing unit is adapted to staple the first and second sealing portions together. In yet another aspect of the present embodiment, the processing unit is adapted too glue the first and second sealing portions together. Furthermore, according to another aspect of the present invention, the sheet processing device may further include a fastening unit adapted to fasten together sheets forming the bundle, wherein the folding unit folds the bundle about a fastened portion of the bundle.

According to yet another aspect of the present invention, the size of the sealing sheet can be changed according to the thickness of the bundle. Moreover, according to another aspect of the present invention, the sheet processing device may further include a sheet separating member adapted to separate the sheets toward the first abutting and second abutting members, wherein the separating member switches depending on whether the sheets to be separated are sheets on which images are formed, or sealing sheets. Moreover, according to another aspect of the present invention, the fastening unit may be a middle fastening unit which fastens an approximate center of the bundle, wherein the folding unit is a half-fold unit which is adapted to fold the bundle in half about the fastened portion thereof.

According to another exemplary embodiment of the present invention, an image forming device is provided which includes an image forming unit adapted to form images on sheets; and a sheet processing device adapted to process bundles of sheets, each bundle defined by an opposing first and second bundle edges, each bundle including a sealing sheet having a larger size than the sheets forming the bundle, the sealing sheet including a sealing portion which projects away from one of the bundle edge. The sheet processing device further includes a folding unit adapted to fold the bundle between the first and second bundle edges; and a processing unit adapted to seal the bundle using the sealing portion of the sealing sheet.

According to yet another exemplary embodiment of the present invention, an image forming device is provided which includes an image forming unit adapted to form images on sheets; and a sheet processing device adapted to process bundles of sheets, each bundle defined by opposing first and second bundle edges, each bundle further including a sealing sheet having a larger size than the sheets forming the bundle, the sealing sheet including a first and second sealing portion which projects away from the first and second bundle edges, respectively. The device further includes a folding unit adapted to fold a bundle between the first and second bundle edges; a processing unit adapted to seal the bundle using the first and second sealing portions.

Further features and aspects of the present invention will become apparent from the following description of exemplary embodiments with reference to the attached drawings.

DESCRIPTION OF THE EMBODIMENTS

Exemplary embodiments, features and aspects of the present invention will be described in details with reference to the drawings. It should be noted that the following is merely illustrative in nature and is in no way intended to limit the invention, its application, or uses. Dimensions, materials, shapes, relative placements, and so forth, of the components described in the embodiments, are not intended to restrict the scope of the present invention thereto, unless specifically stated that these are restrictive in nature.

First Exemplary Embodiment

Figure 1:
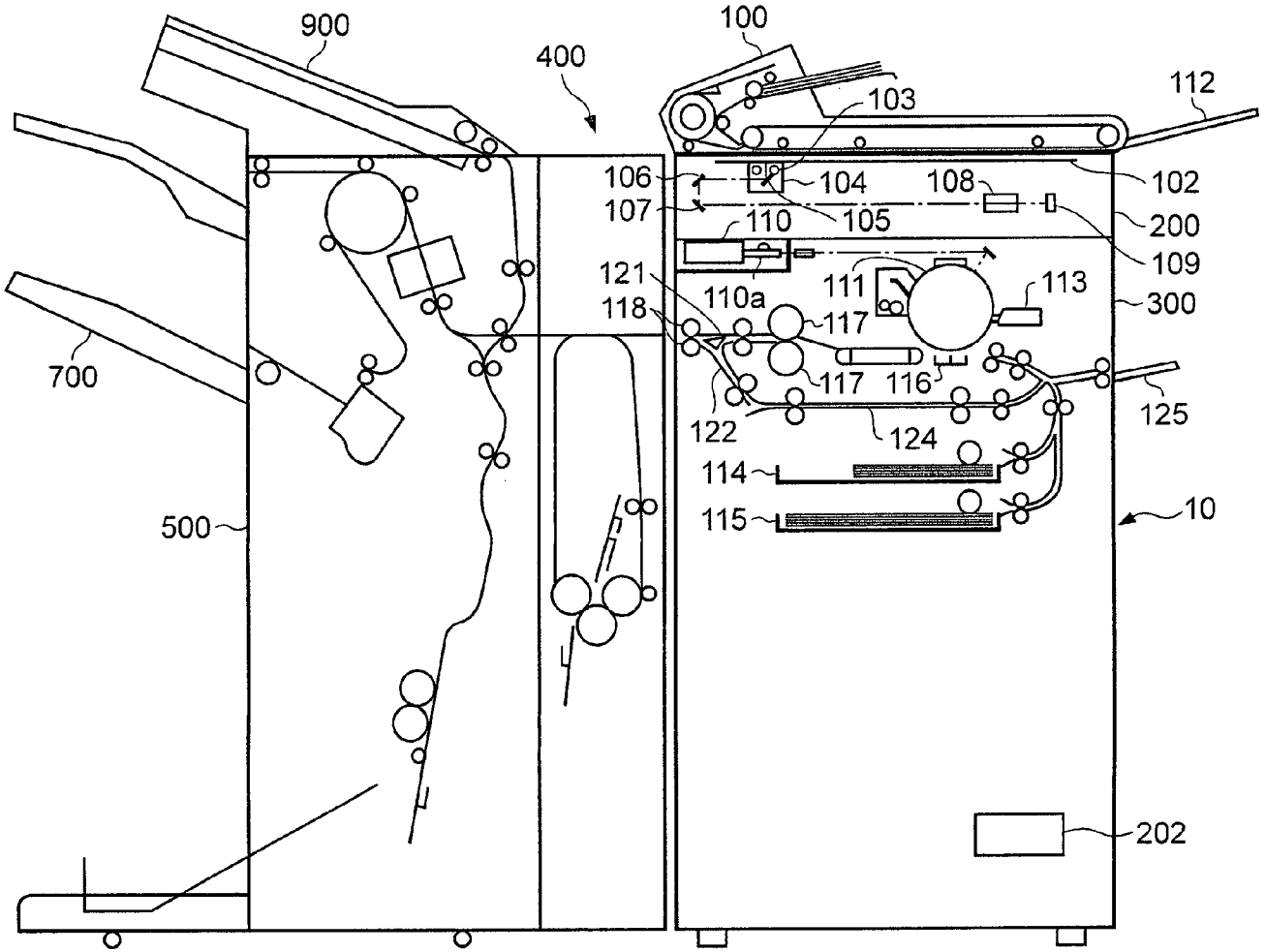
FIG. 1 is a cross-sectional diagram describing an exemplary image forming device according to an embodiment of the present invention.
Figure 2:
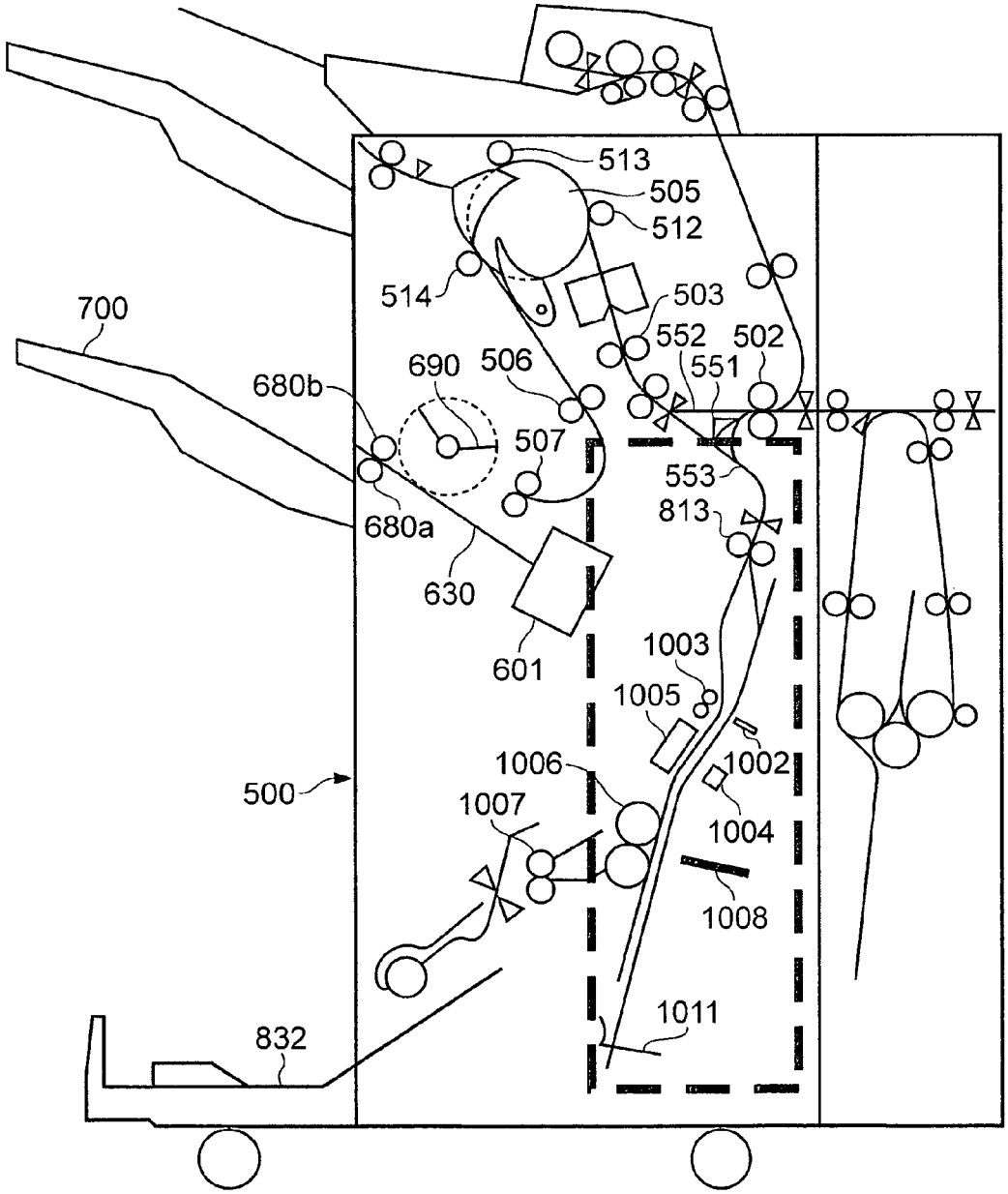
FIG. 2 is a cross-sectional view schematically illustrating an exemplary overall configuration of a sheet processing device relating to a first embodiment.
Figure 3:
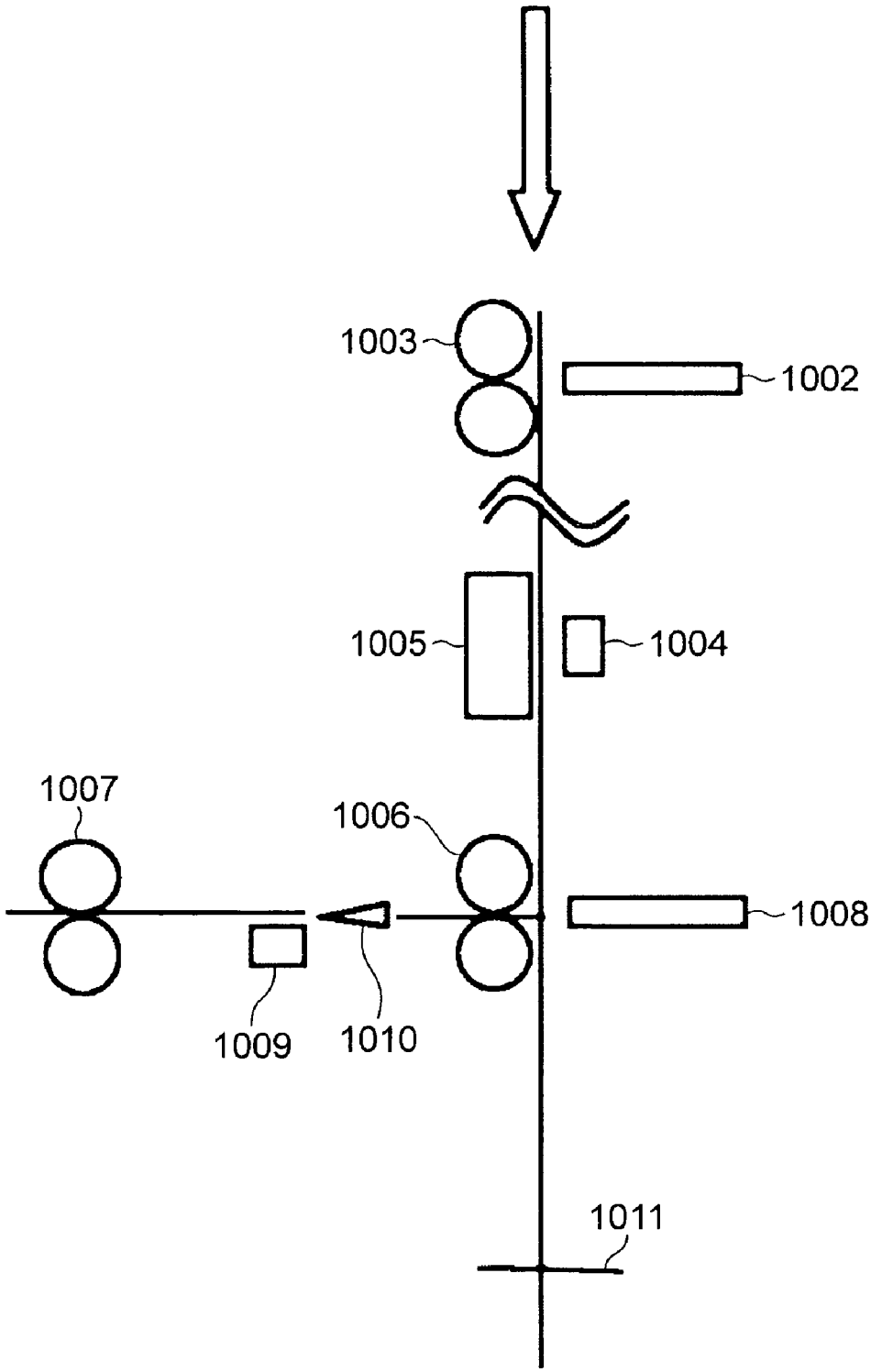
FIG. 3 is a cross-sectional diagram illustrating details of portions of the sheet processing device, according to an aspect of the present invention.

An exemplary sheet processing device relating to a first exemplary embodiment, and an exemplary image forming device on which the sheet processing device is provided, will be described with reference to FIGS. 1 through 6. FIG. 1 is a cross-sectional diagram illustrating an exemplary configuration of the image forming device according to the present embodiment, FIG. 2 is a cross-sectional view schematically illustrating an overall configuration of the sheet processing device relating to the present embodiment, FIG. 3 is a cross-sectional diagram illustrating details (configuration of the portions enclosed by the broken lines in FIG. 2) of the sheet processing device relating to the present embodiment, and FIGS. 4 through 6 are cross-sectional diagrams illustrating the flow of an exemplary operation of a sheet being sealed.

The present embodiment shows an example of a sheet processing device which is removable as to an image forming device which forms images on a sheet. First, the overall configuration of the image forming device will be briefly described, and then the sheet processing device will be described in detail.

FIG. 1 is a cross-sectional diagram showing an exemplary configuration of the image forming device according to the present embodiment. The image forming device includes an image forming device main unit 10, a folding device 400, and a sheet processing device 500. The image forming device main unit 10 further includes an image reader 200 which reads document images, and a printer 300, as shown in FIG. 1.

The image reader 200 has a document feeding device 100 mounted thereupon. The document feeding device 100 feeds the document which has been set face up in the document tray, one sheet at a time from the first page, into the direction to the left in FIG. 1, and via a bent path passes over a platen glass 102 from the left in FIG. 1 and transports it past the reading position and to the right in FIG. 1, and after this discharges the sheet toward an external discharge tray 112. When the document passes over the reading position on the platen glass 102 from left to right, the document image is read by a scanner unit 104 which is held at a position corresponding to the ADF (Auto-Document Feeder) scan position.

This reading method is a document reading method generally called ADF scanning. Specifically, at the time when the document passes over the ADF scan position, the image face to be read of the document is illuminated with the light of the lamp 103 of the scanner unit 104, and the reflected light from the image face to be read of the document is led to a lens 108 via mirrors 105, 106, and 107. The light which has passed through the lens 108 forms an image on the imaging face of the image sensor 109.

By transporting the document by passing the document over the ADF reading position from left to right in FIG. 1, a document reading scan is performed, wherein the direction which is orthogonal as to the transportation of the document is the main scan direction, and the direction of transportation of the document is the sub-scan direction. In other words, in the event that the document passes over the ADF reading position, the document image is read one line at a time in the main scan direction by the image sensor 109, while at the same time the document is transported in the sub-scan direction, and thus the reading of the entire document image is performed, and the image which is read optically is converted into image data by the image sensor 109 and is output. The image data output from the image sensor 109 has predetermined processing performed thereupon with an image signal control unit 202, and after this is input into an exposure control unit 110 of a printer 300 as a video signal.

Also, an arrangement may be made wherein the document is transported over the platen glass 102 with the document feeding device 100 and stopped at a predetermined position, where the document is read by the scanner unit 104 scanning from left to right. This reading method is a method called document fixed reading.

If the document is a thick document in book form (book document), the user may directly place the book document on the platen glass 102 and perform reading, instead of using the document feeding device 100. When the document is read without using the document feeding device 100, first the user lifts up the document feeding device 100 and places the document on the platen glass 102, and then sets the document feeding device 100 so as to hold down the document on the platen glass 102, and performs reading of the document by having the scanner unit 104 scan from left to right and thus read the document. In other words, even when the document feeding device 100 is not used to read the document, document fixed reading can be performed.

The exposure control unit 110 of the printer 300 modulates and outputs the laser light based on the input video signal. The laser light is irradiated on a photosensitive drum 111 while being scanned with a polygon mirror 110*a*. The photosensitive drum 111 has a static latent image formed thereupon according to the scanned laser light.

The static latent image on the photosensitive drum 111 can become visible as a developed image by the developer supplied by the developing device 113. Also, with synchronized timing with the irradiation start of the laser light, a recording sheet (hereafter called sheet) is fed from one of the cassettes 114 and 115 and a manual feeding paper unit 125 or a double-sided transportation path 124 and this sheet is transported between the photosensitive drum 111 and a copying unit 116. The developed image which is formed on the photosensitive drum 111 is copied onto the sheet which has been fed at the copying unit 116.

The sheet on which the developed image is copied is transported to a fixing unit 117, and by heating and pressing the sheet with the fixing unit 117, the developed image is fixed onto the sheet. The sheet which passes through the fixing unit 117 passes a flapper 121 and a discharge roller 118, and is discharged toward the exterior of the printer 300 (folding device 400).

When the sheet is to be discharged with the image-formed face facing down (face down), the sheet which has passed the fixing unit 117 is led temporarily to an inversion path 122 with a switching operation of the flapper 121, and after the trailing edge of the sheet has passed the flapper 121, the sheet is switched back and is discharged from the printer 300 with the discharge roller 118. Hereafter, this discharge sheet formation will be called face-down discharging. Face-down discharging is performed when an image is formed from the front page, in order, such as when a image which is read from the document transported to the reading position by the document feeding device 100 is to be formed, or when an image output from a computer is to be formed, and the sheet order after facedown discharge is in the correct page order.

Also, when a stiff sheet such as an overhead projection (OHP) sheet is fed from the manual feeding unit 125, and an image is to be formed upon this sheet, the sheet is not led to the reverse path 122, and the sheet is discharged by the discharge roller 118 with the image-formed face facing upward (face up).

Further, in the case that double-sided recording is set which performs image forming on both sides of the sheet, the sheet is led to the reverse path 122 with the switching operation of the flapper 121 and after this is transported to the double-sided transportation path 124, and a control is performed wherein the sheet led to the double-sided transportation path 124 is fed again between the photosensitive drum 111 and the copying unit 116 with the above-described timing.

The sheet which is discharged from the printer 300 is sent to the folding device 400. This folding device 400 performs processing to fold the sheet into a Z-shape. For example, with an A3 size or B4 size sheet, wherein folding processing is specified, folding processing is performed with the folding device 400, and in all other cases, the sheet which is discharged from the printer 300 passes through the folding device 400 and is sent to the sheet processing device 500. On this sheet processing device 500 is provided an inserter 900 which feeds specialized sheets such as a cover sheet for binding the sheets on which images are formed, or a divider sheet which is inserted into a sheet bundle as a divider. Also, with the sheet processing device 500, various processing is performed such as bookbinding processing, fastening processing, or hole-opening.

[Exemplary Configuration of Sheet Processing Device]

Next, overall exemplary configuration of the sheet processing device will be described below along with a description of exemplary processing operations of the sheet bundle, with reference to FIGS. 2 and 3. Then, an exemplary configuration of the sheet processing device and the processing operation thereof which seals a sheet bundle will be described in detail with reference to FIGS. 4 through 6.

First, an overall configuration of the sheet processing device will be described below along with an exemplary processing operation of a sheet bundle, with reference to FIGS. 2 and 3. The sheet processing device 500 shown in FIGS. 2 and 3 can perform well-known processing, other than the processing for sealing a sheet bundle, which is described below, as processing to be performed on a sheet bundle. For example, processing which does not seal a sheet bundle, such as saddle-stitch binding or flat-stitch binding can also be performed.

For instance, with a process for saddle-stitching a sheet bundle, the sheet which is sent from the image forming device advances to a roller pair 502, the facing direction thereof is changed to the direction of a sheet transportation path 553 with a flapper 551, the sheet passes through a roller pair 813, and stops at an abutting member 1011. When all of the sheets which are to be subjected to saddle-stitch binding are abutted to the abutting member 1011 and aligned, the approximate center of the sheet bundle is stapled with stapler units 1004 and 1005. After this, the abutting member 1011 moves downward and the sheet bundle which has been stapled also moves downward, and a folding rod 1008 for folding the sheet bundle in half protrudes towards the sheet bundle and leads it to a folding roller pair 1006 for folding the sheet bundle, and the sheet bundle is folded in half. After this, the sheet bundle is led by a roller pair 1007 and is discharged to a discharge tray 832.

On the other hand, with a process for flat-stitch binding of a sheet bundle, the sheet which is sent from the image forming device passes through the roller pair 502, the facing direction thereof is switched to the direction of a sheet transportation path 552 with the flapper 551, the sheet passes through the rollers in the order of 503, 505, 512, 513, 514, 506, and 507, and is discharged onto a processing tray 630. The sheets discharged onto the processing tray 630 have the sheet edges thereof abutted against an edge abutter (not shown) on the side of a stapler unit 601 by a returning member 690 which rotates in a counter-clockwise direction, and are aligned. After all of the sheets to have flat-stitch binding performed thereupon are aligned, one edge portion of the sheet bundle on the processing tray 630 is stapled by the stapler 601. After this, the sheet bundle is discharged onto a discharge tray 700 by a roller pair 680*a* and 680*b* which can be in contact with one another or be separated.

Next, the configuration of the sheet processing device relating to the present embodiment and the processing operation thereof which seals a sheet bundle will be described in detail with reference to FIGS. 4A through 6. With the present embodiment, the processing operation for sealing the sheet bundle to be subjected to saddle-stitching described above, will be described as an example.

As described above with reference to FIGS. 2 and 3, the sheet processing device comprises the abutter 1011, stapler units 1004 and 1005, the folding rod 1008, and the folding roller pair 1006. The abutter 1011 is an abutting member for aligning one edge portion of the sheet bundle which is formed from multiple sheets. Also, the stapler units 1004 and 1005 are fastening units for fastening the sheet bundle. Also, the folding rod 1008 and the folding roller pair 1006 comprise a folding unit folding the sheet bundle.

With the present embodiment, the stapler units 1004 and 1005 which are bundle fastening units use a saddle-stitch unit for fastening the approximate center of the sheet bundle. In the same way, the folding rod 1008 and folding roller pair 1006, which are a folding unit, are a two-fold unit for folding a sheet bundle in half.

The sheet processing device inserts a large sheet as a sealing sheet, which is of a size larger than the other sheets, into the sheet bundle when performing processing to seal the sheet bundle. The large sheet to be inserted into the sheet bundle for this sealing process can be a sheet on which an image is formed with the image forming device, or a sheet specifically for sealing processing can be transported from the inserter 900.

Also, the sheet processing device has a folding rod 1002 and a folding roller pair 1003 as a sealing portion folding unit for folding the protrusion of the large sheet which protrudes from an edge portion of the sheet bundle. Further, the sheet processing device has a gluing device 1009 and a flapper 1010 which are a processing unit for sealing the edge portion of the sheet bundle using the folded protrusion as a sealing portion of the large sheet.

With the present embodiment, the processing unit adheres the folded protrusion of the large sheet and the other edge portion of the large sheet which is on the outer-most side of the sheet bundle, for the purpose of sealing the edge portion on the open side of the sheet bundle.

Now, the processing for sealing the edge portion on the open side of the sheet bundle will be described, using the protrusion as a sealing portion of the large sheet which protrudes from the edge portion of the open side which is on the opposite side from the folded side of the sheet bundle on which the above saddle-stitch processing and two-fold processing is to be performed.

First, the image forming device sends a sheet on which an image is formed to the sheet processing device. A sheet which is to seal a sheet bundle which is subjected to saddle-stitch binding is selected as a large sheet, which is of a size larger than the other sheets, by a controller 20 of the image forming device shown in FIG. 1. The sheet which is to seal the sheet bundle can be selected from either the image forming device or the inserter 900. The sheets which are sent to the sheet processing device pass the sheet transportation path within the device, and are abutted and aligned with the abutter 1011.

Now referring to FIGS. 4 through 6, with regard to the sheet bundle to have saddle-stitch binding performed, the large sheet which seals the sheet bundle is shown as S1, and the other sheets are shown as S2. In the diagram, the large sheet S1 is shown with a thick black line, and the other sheets S2 are shown with a white framed line, but these sheets S1 and S2 are schematically illustrated, and are not to specify the thickness of the sheet or the number of sheets. The sheets which are sent from the sheet processing device are layered in the order they come through the sheet transportation path. The large sheet S1 which seals the sheet bundle is transported last, and is layered so as to be on the outer-most side of the sheet bundle in the state when the saddle-stitching processing and two-fold processing is performed.

Figure 4A:
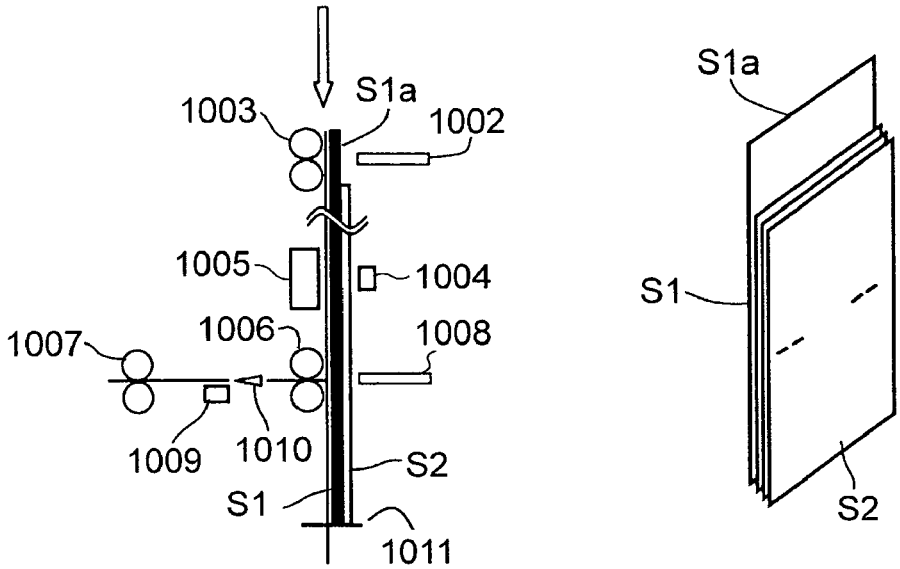
FIGS. 4A and 4B are cross-sectional diagrams illustrating the flow of an exemplary operation of a sheet bundle being sealed with the sheet processing device, according to an aspect of the present invention.

When all of the sheets to be saddle-stitched together are abutted against the abutter 1011 and are aligned, and approximate center of the sheet bundle is stapled with the staple units 1004 and 1005 (FIG. 4A). With the present embodiment, the large sheet S1 as a sealing sheet is transported last, but as long as the large sheet S1 is on the outer-most side of the sheet bundle when the saddle-stitching processing and two-fold processing is performed, the large sheet S1 can be transported first and have the other sheets S2 layered thereupon.

Figure 4B:
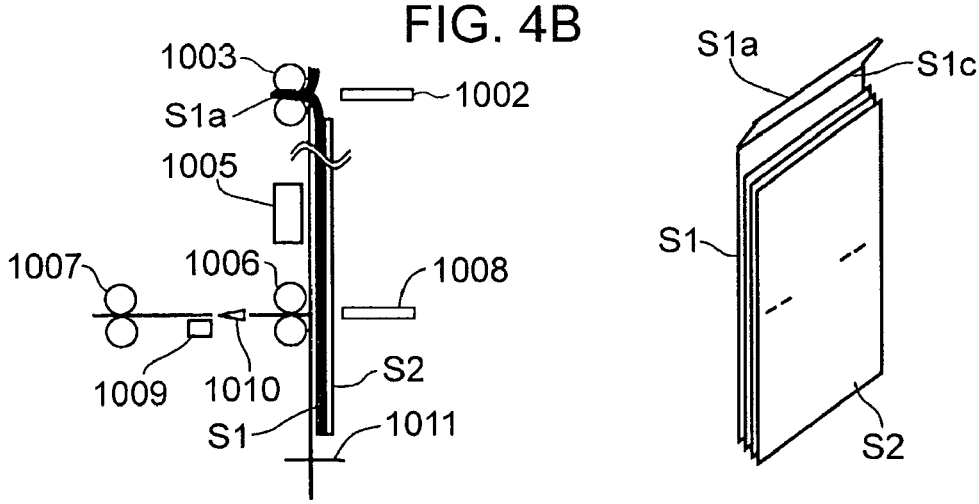

Next, by moving the folding rod 1002, which folds the protrusion S1*a* of the large sheet S1 which protrudes from an edge portion of the sheet bundle, so as to protrude into the transportation path toward the large sheet, the protrusion S1*a* of the large sheet S1 protrudes in the direction of the folding roller pair 1003. The protrusion S1*a* of the large sheet S1 which processes the sheet bundle is folded over by being sandwiched between the rotating folding roller pair 1003 (FIG. 4B). Thus, a fold S1*c* is created on the protrusion S1*a* of the large sheet S1.

When the protrusion S1*a* of the large sheet S1 is gripped by the folding roller pair 1003, the abutter 1011 moves downward to provide the two-fold processing of the sheet bundle which has been saddle-stitched. Also, when the large sheet protrusion S1*a* is folded over, the folding roller pair 1003 rotates in reverse and the large sheet protrusion S1*a* is discharged from the folding roller pair 1003. Simultaneously as the large sheet protrusion S1*a* is discharged from the folding roller pair 1003, the saddle-stitched sheet bundle falls until it abuts against the abutter 1011 which has moved downward. Then the sheet bundle which abuts against the abutter 1011 is pushed in the direction of the folding roller pair 1006 by the folding rod 1008 for folding the sheet bundle in half, and the entire sheet bundle is gripped and transported by the folding roller pair 1006, and folded in half (FIG. 5A).

The sheet bundle which is folded in half is gripped and transported by the roller pair 1007 on the downstream side, and the trailing edge (the protrusion as a sealing portion of the large sheet) thereof passes through the folding roller pair 1006 and advances to a predetermined position (processing unit). When the trailing edge of the sheet bundle advances to the predetermined position, gluing is performed on the lower face S1*b* of the sheet bundle by the gluing device 1009. The lower face S1*b* of the sheet bundle which is to be glued is the edge portion face of the sheet on the outer-most side of the sheet bundle, and with the present embodiment, whereas one edge portion is the protrusion S1*a* as a sealing portion, the other edge portion is S1*b*. Simultaneously with the gluing processing, the flapper 1010 operates so as to fold the protrusion S1*a* along the fold mark S1*c*, so that the protrusion S1*a* of the large sheet S1 faces the glued other edge portion S1*b* (FIG. 5B).

Figure 5A:
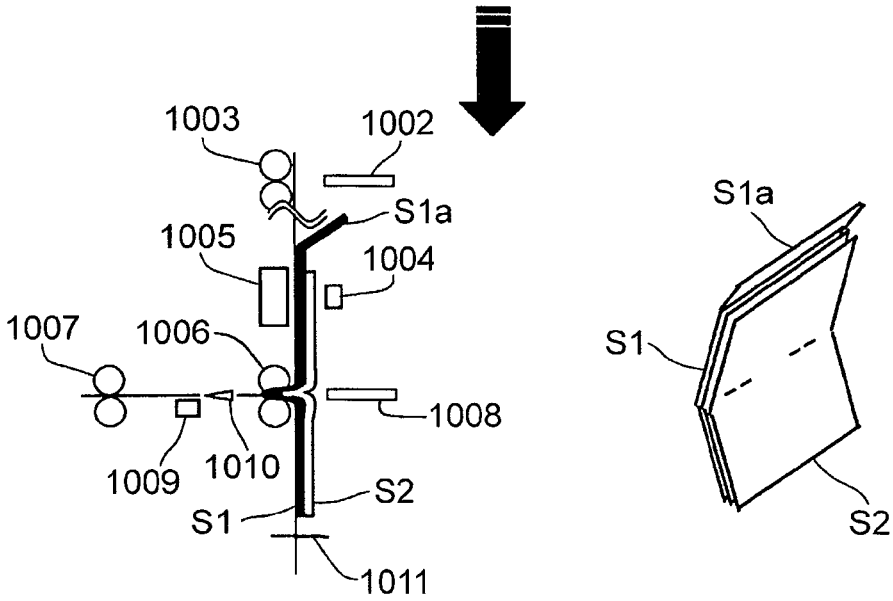
FIGS. 5A and 5B are more cross-sectional diagrams illustrating the flow of the operation of a sheet bundle being sealed with the sheet processing device, according to an aspect of the present invention.
Figure 5B:
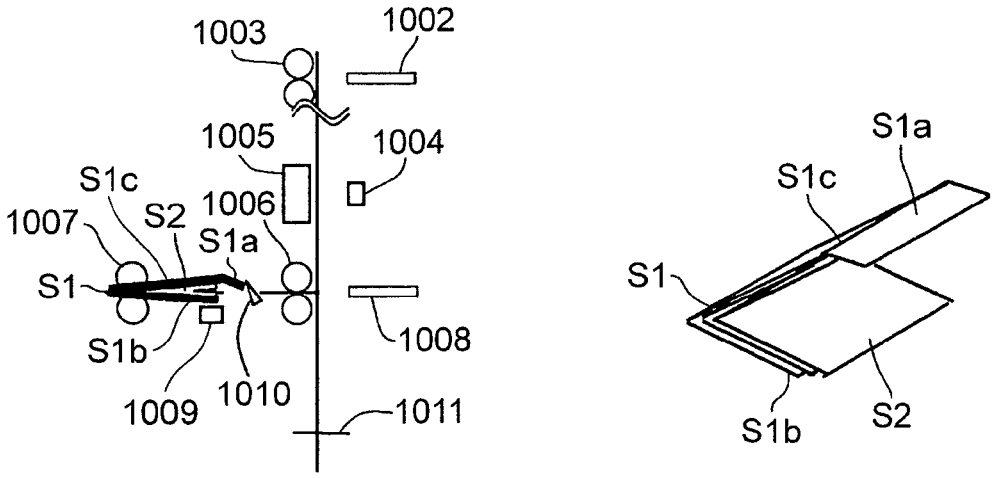
Figure 6:
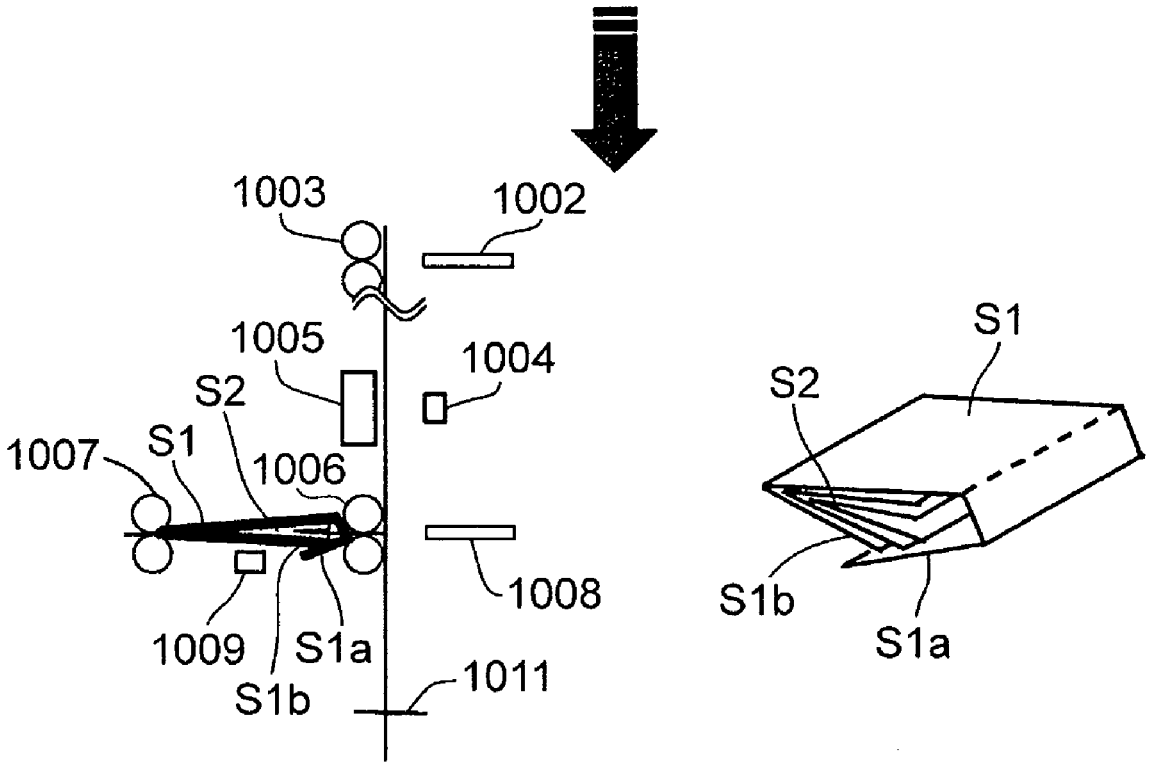
FIG. 6 is yet another cross-sectional diagram illustrating the flow of the operation of a sheet bundle being sealed with the sheet processing device, according to an aspect of the present invention.

Also, the roller pair 1007 are rotated in reverse, and so the transportation direction of the sheet bundle is rotated in reverse, and by returning the flapper 1010 to the position shown in FIG. 5A with the appropriate timing, the protrusion S1*a* of the large sheet S1 which is on the outer-most side of the sheet bundle, and the other edge portion S1*b* can be adhered together. Thus, the edge portion on the open side of the sheet bundle can be processed to be sealed (FIG. 6).

With the sheet bundle which is transported by the reverse-rotated roller pair 1007, the adhered portion (the protrusion S1*a* and the other edge portion S1*b*) of the large sheet S1 is similarly gripped and transported by the reverse-rotating roller pair 1006. Thus, the adhered portion of the sheet bundle will have the gluing strengthened. After this, the sheet bundle on which sealing processing is performed using the protrusion S1*a* of the large sheet S1 is discharged into the discharge tray by the forward rotation of the roller pairs 1006 and 1007.

Thus, the output bundle can be made so as to not open, and the information within can be shielded. With the present embodiment, processing is performed for sealing the outermost side of the sheet bundle wherein the large sheet S1 is folded in half, and the information in the entire sheet bundle is shielded, but in the case that only a portion of the information must be shielded, as long as the large sheet S1 is farther towards the outside than the information needing to be shielded, the large sheet S1 does not need to be at the outermost of the sheet bundle and can be inserted in the middle thereof. The portion of the sheet bundle on the outside of the large sheet S1 can be viewed without opening.

With the present embodiment, the folding rod 1002 for making a fold mark S1*c* on the protrusion S1*a* of the large sheet S1, the folding roller pair 1003, the folding rod 1008 for folding the entire sheet bundle in half, and the folding roller pair 1006 are provided, but a shared folding mechanism can perform making a fold mark S1*c* on the protrusion S1*a* and folding the entire sheet bundle in half. However, since it takes time for the sheet bundle to be transported to the various folding positions, providing separate folding mechanisms is favorable in order to shorten the total processing time.

As described above, according to the present embodiment, the edge portion of the open side of the sheet bundle is sealed, using the protrusion S1*a* which protrudes from the sheet bundle edge portion of the large sheet S1 in the sheet bundle, and so a third party can be kept from easily viewing the content of the sheet bundle. Also, the protrusion S1*a* of the large sheet S1 seals the sheet bundle, and is torn to unseal the sheet bundle. Accordingly, staple holes do not remain on all opening side portions, thereby minimizing damage to the sheet bundle.

Second Exemplary Embodiment

A sheet processing device relating to a second exemplary embodiment will be described with reference to FIG. 7 which is a cross-sectional diagram showing portions of the sheet processing device relating to the present embodiment. The overall configuration of the sheet processing device is similar to the above-described embodiment, and so a detailed description thereof will be omitted.

The sheet processing device relating to the present embodiment further has, in addition to the above-described configuration of the first embodiment, a cutter 1012 which adds perforations S1*d* to the protrusion S1*a* of the large sheet S1, for the purpose of opening the sheet bundle.

Figure 7:
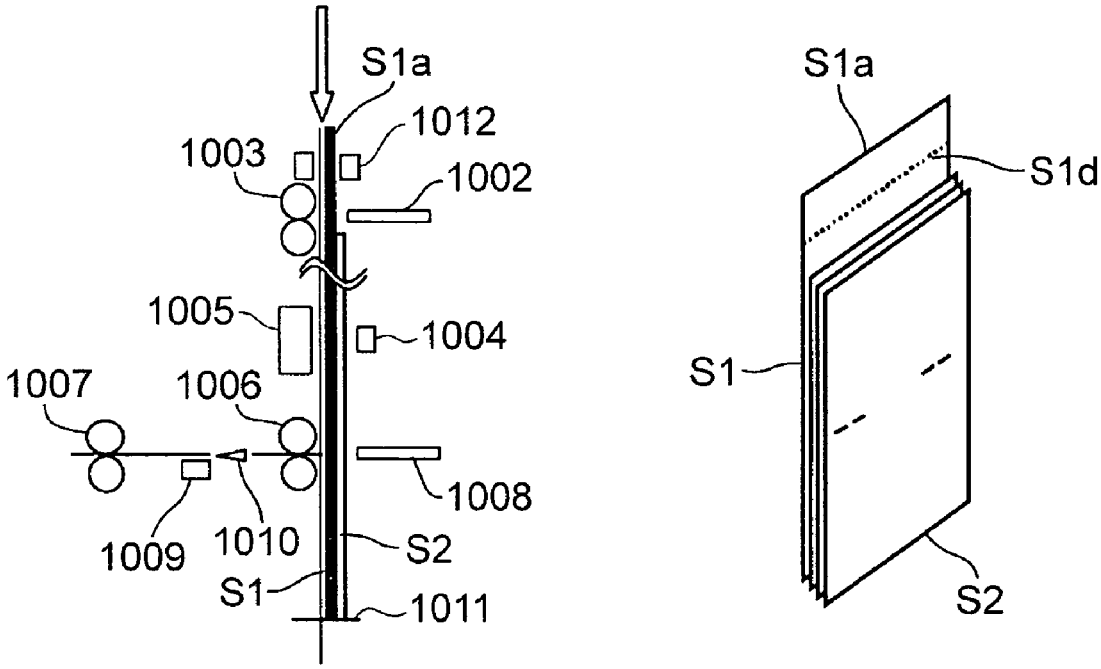
FIG. 7 is a cross-sectional diagram illustrating exemplary details of the sheet processing device relating to a second embodiment.

Accordingly, with the present embodiment, as shown in FIG. 7, a perforation S1*d* is made with the cutter 1012 to the protrusion S1*a* of the large sheet S1 which seals the sheet bundle, as to the protrusion S1*a* of the large sheet S1 which protrudes from one edge portion of the sheet bundle. The operations other than this operation are the same as those described in the first embodiment, so the description will be omitted here.

As described above, according to the present embodiment, perforations S1*d* are added to the protrusion S1*a* of the large sheet S1 which seals the sheet bundle for the purpose of opening the sheet bundle, and therefore in addition to the advantages described above in the first embodiment, the sealed sheet bundle can be easily opened. Also, damage to the sheet bundle can be further suppressed in the event of opening the sheet bundle. Also, the sealed sheet bundle can be easily opened.

Third Exemplary Embodiment

A sheet processing device relating to a third exemplary embodiment will be described with reference to FIG. 8 which is a cross-sectional diagram showing portions of the sheet processing device relating to the present embodiment. The overall configuration of the sheet processing device is similar to the above-described embodiment, and so a detailed description thereof will be omitted.

The sheet processing device relating to the present embodiment further has, in addition to the above-described configuration of the first exemplary embodiment, a configuration wherein the folding position of the protrusion S1*a* of the large sheet S1, which is made by the folding rod 1002 and folding roller pair 1003 as a sealing portion folding unit, can be changed according to the thickness of the sheet bundle to be sealed.

Figure 8:
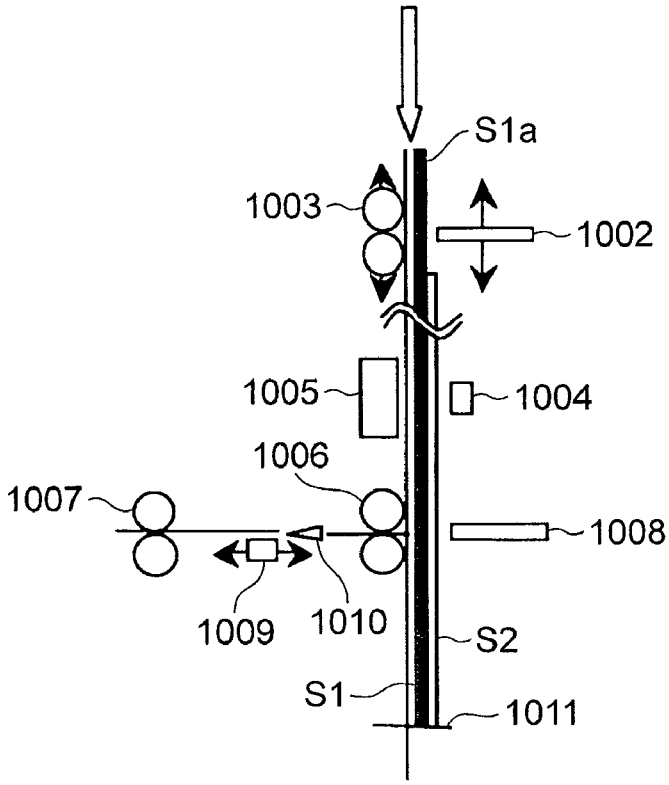
FIG. 8 is a cross-sectional diagram illustrating exemplary details of the sheet processing device relating to a third embodiment.

Further specifically, as shown in FIG. 8, with the present embodiment, the folding rod 1002 and folding roller pair 1003 can move in the arrow direction, and can move the folding position of the protrusion S1*a* of the large sheet S1, according to the thickness of the sheet bundle to be sealed.

The operations other than the operation which folds the large sheet which process the sheet bundle are similar to those described in the first embodiment, so the description will be omitted here.

Conventionally, with an image forming device, the number of sheet bundles to be output and the sheet types are known when forming the images on the sheets. Thus, the approximate thickness of the sheet bundle can be estimated somewhat. Thus, with the present embodiment, as shown in FIG. 8, the position to fold the protrusion S1*a* of the large sheet S1 which processes the sheet bundle can be changed according to the estimation thereof. Specifically, the folding rod 1002 and folding roller pair 1003 which add a fold mark S1*c* to the protrusion S1*a* of the large sheet S1 can be moved to a position according to the thickness of the sheet bundle. Thus, and therefore in addition to the advantages described above in the first exemplary embodiment, the sheet bundle sealing processing can be maintained in a state of not being too loose or too tight.

Fourth Exemplary Embodiment

Figure 9:
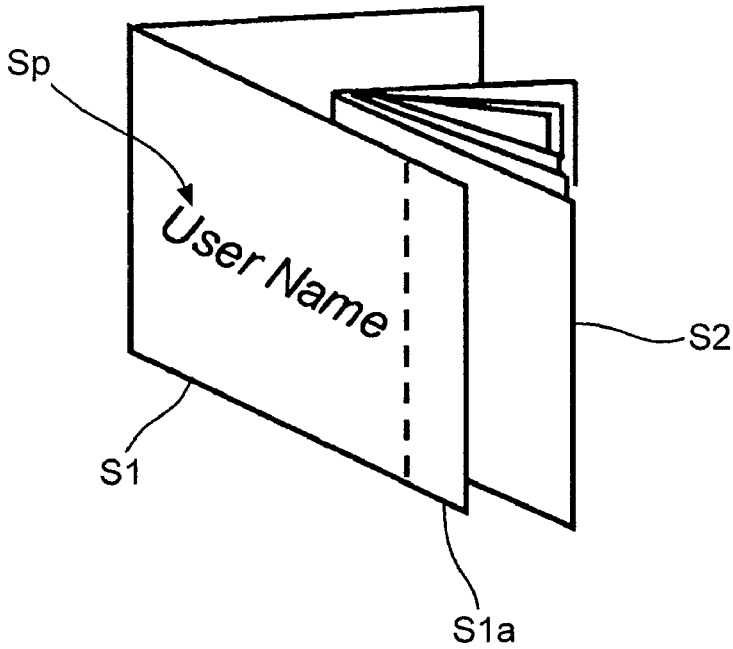
FIG. 9 is a perspective view illustrating an exemplary frame format of the sheet bundle on which processing is performed with the sheet processing device relating to a fourth embodiment.

A sheet processing device relating to a fourth exemplary embodiment will be described with reference to FIG. 9 which is a perspective view schematically illustrating the sheet bundle on which processing is performed with the sheet processing device relating to the present embodiment. The overall configuration of the sheet processing device is similar to the above-described embodiment, and so detailed description thereof will be omitted.

One of the reasons for processing the sheet bundle is to shield the information within the sheet bundle from a third party. Therefore, if the large sheet which processes the sheet bundle is a sheet on which no image is formed, or a thin sheet through which the inside can be seen, problems may be anticipated such as (1) in the case a large number of sheet bundles are output, the sheet bundle cannot be distinguished from the sheet bundle of another user, and (2) a white sheet allows the information inside to be seen through.

Thus, with the sheet processing device relating to the present embodiment, the following measures are taken as to the problems in (1) and (2) above.

First, as to the problem in (1), as shown in FIG. 8, an identifier (such as a username) Sp for each user for identifying the sheet bundle is recorded on the large sheet of the sheet bundle. Thus, in the case that a large number of sheet bundles are output, one's own sheet bundle can be easily identified from the large number of sheet bundles even when sealing processing is performed thereupon.

On the other hand, as to the problem in (2) above, a shielding image is recorded onto the large sheet of the sheet bundle, so as to shield the content within the sheet. Specifically, the inner side of the large sheet which processes the sheet bundle is colored with a color so that the content within the sheet cannot be seen through. Now, the recording of the above-described shielding image is not limited to coloring with a color which cannot be seen through, and other shielding images can be used, such as for example, a design which would prevent the content within the sheet from being determined. Thus, in the case of sealing the large sheet which processes the sheet bundle, the content thereof being seen through can be prevented.

Fifth Exemplary Embodiment

Figure 11A:
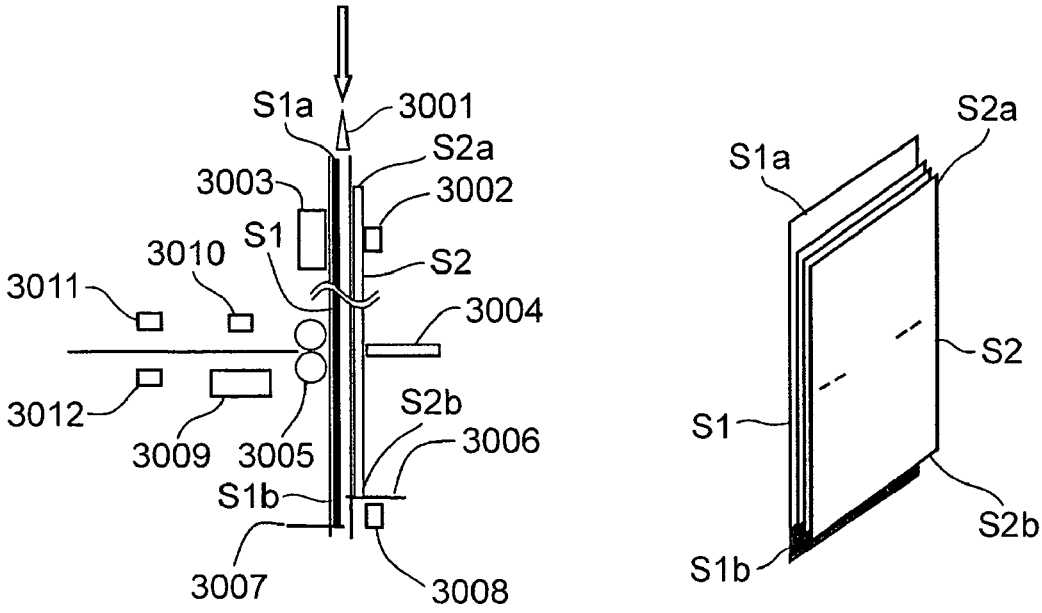
FIGS. 11A and 11B are cross-sectional diagrams illustrating the flow of an exemplary operation of a sheet bundle being sealed with the sheet processing device.
Figure 11B:
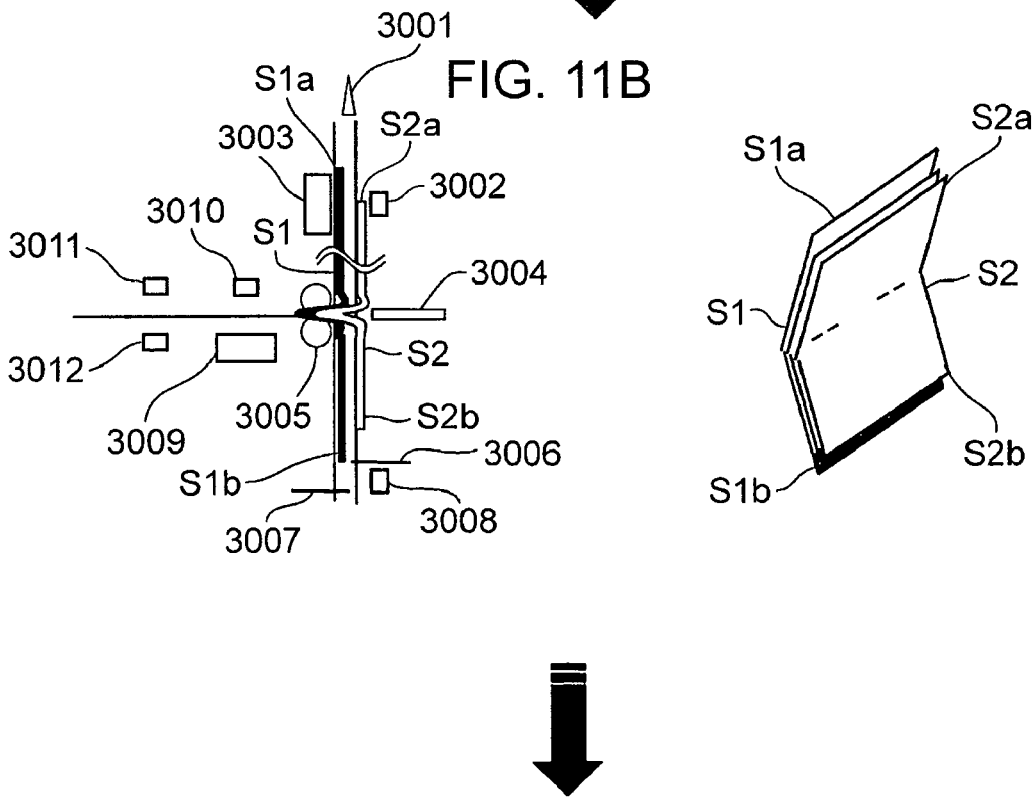
Figure 12:
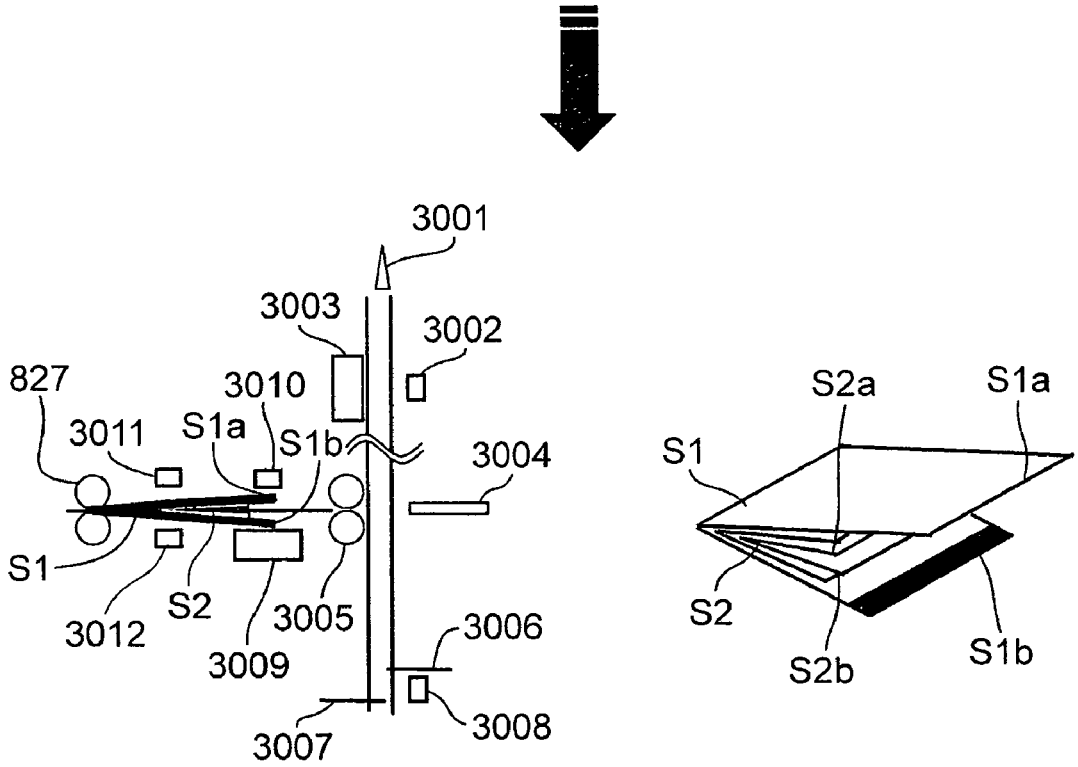
FIG. 12 is cross-sectional diagram illustrating the flow of an exemplary operation of a sheet bundle being sealed with the sheet processing device.

Next, the configuration of the sheet processing device relating to a fifth exemplary embodiment and the processing operation to seal a sheet bundle performed with such configuration will be described in detail with reference to FIGS. 10 through 12. With the present embodiment, description will be given with the processing operation of sealing the above-described saddle-stitching binding as an example.

Figure 10:
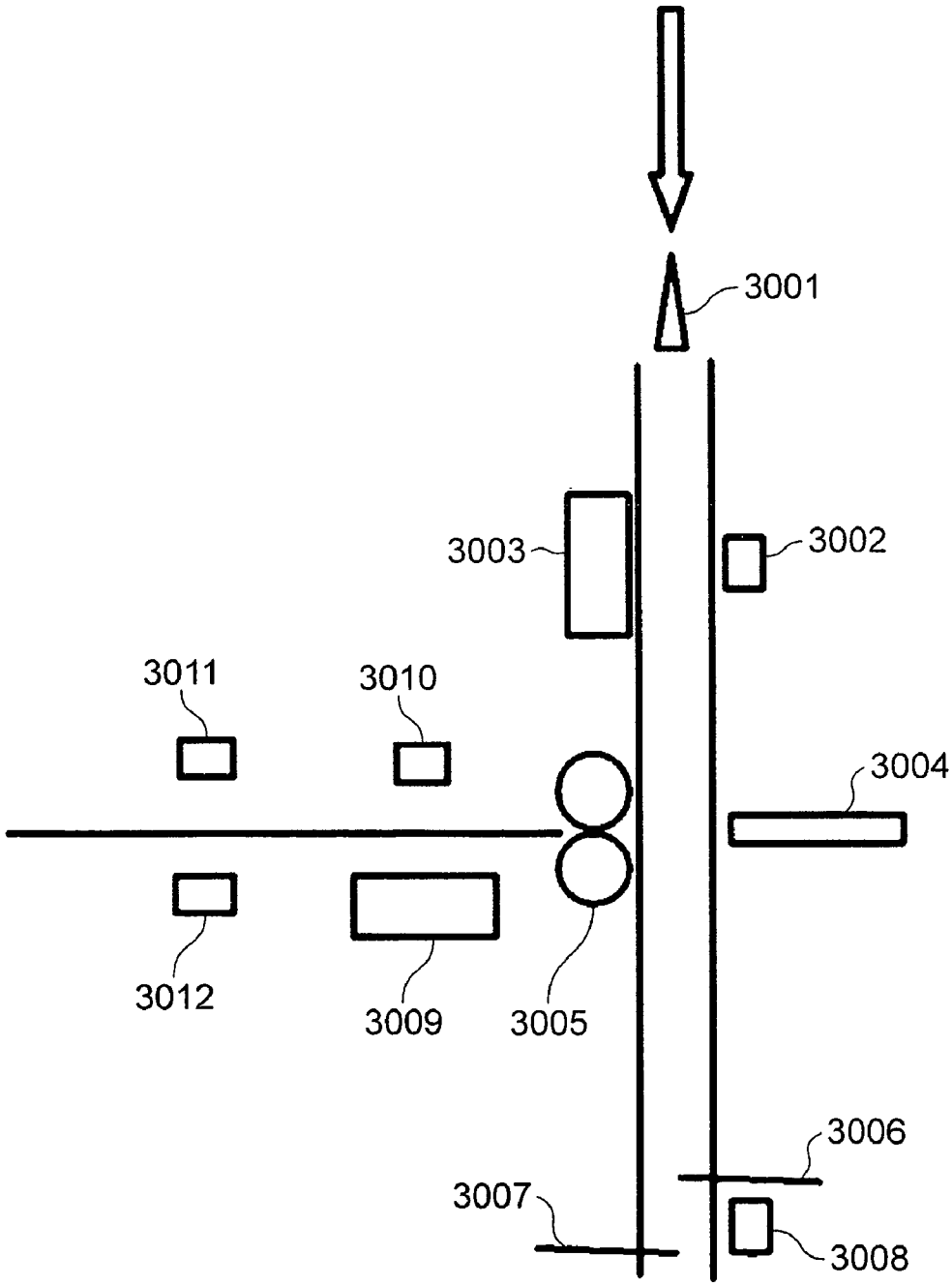
FIG. 10 is a cross-sectional diagram illustrating exemplary details of a sheet processing device relating to a fifth embodiment.

As shown in FIG. 10, the sheet processing device relating to the present embodiment has stapler units 3002 and 3003, a folding rod 3004 and a folding roller pair 3005. The stapler units 3002 and 3003 are bundle fastening units which fasten a sheet bundle which are formed of multiple sheets. Also, the folding rod 3004 and folding roller pair 3005 are a folding unit for folding the sheet bundle.

With the present embodiment, the stapler units 3002 and 3003 which are bundle fastening units use a saddle-stitch unit for fastening the approximate center of the sheet bundle. Similarly, the folding rod 3004 and folding roller pair 3005, which are a folding unit, are a two-fold unit for folding a sheet bundle in half.

The sheet processing device includes a large sheet, which is of a size larger than the other sheets, in the sheet bundle when performing processing to seal a sheet bundle. The large sheet to be included in the sheet bundle for this sealing process can be a sheet on which an image is formed with the image forming device, or a sheet specifically for sealing processing can be transported from the inserter 900. Here, in FIGS. 10 through 12, of the sheet bundle to have saddle-stitch binding performed, the large sheet which seals the sheet bundle is shown as S1, and the other sheets which are of a size smaller than the large sheet S1 are shown as S2. In the diagram, the large sheet S1 is shown with a thick black line, and the other sheets S2 are shown with a white framed line, but these sheets S1 and S2 are schematically illustrated, and are not to specify the thickness of the sheet or the number of sheets.

The sheet processing device has an abutter 3007, in addition to the above-described abutter 3006. The abutter 3006 is a first abutting member for abutting the one edge portion S2*b* of the other sheet S2 which excludes the large sheet S1, of the sheet bundle including the large sheet S1. Also, the abutter 3007 is a second abutting member for abutting the one edge portion S1*b* of the large sheet S1 in a position differing from that of the first abutter 3006. This second abutter 3007 is an abutting member for abutting the edge portion S1*b* of the large sheet S1 so that the one edge portion S1*b* and the other edge portion S1*a* of the large sheet S1 protrudes from the one edge portion Sb2 and the other edge portion S2*a* of the other sheets S2 which exclude the large sheet S1, as shown in FIG. 11A.

The sheet processing device has a flapper 3001 which is a separating member for performing separating processing of the sheets S1 and S2 in the case that the sheet bundle includes a large sheet S1 which is of a size larger than the other sheets S2. This flapper 3001 switches the direction of sheet transportation depending on whether the sheet sent from the image forming device or inserter 900 to the sheet processing device is a large sheet S1 or the other sheet S2 which is of a size smaller than the large sheet S1. Of the sheets S1 and S2 separated by the flapper 3001, the other sheets S2 abut against the first abutter 3006 and stop and the large sheet S1 abuts against the second abutter 3007 and stops.

Further, the sheet processing device has a processing unit which seals the edge portion of the sheet bundle using one edge portion S1*b* and other edge portion S1*a* of the large sheet S1 which protrudes from the one edge portion S2*b* and other edge portion S2*a* of the other sheets S2. The present embodiment has stapler units 3009 and 3010 as staple fastening units which staple the one edge portion S1*b* and other edge portion S1*a* which protrude of the large sheet S1, as a processing unit.

Here, the processing for sealing the edge portion on the open side of the sheet bundle will be described, using the edge portions S1*b* and S1*a* of the large sheet which protrudes from the edge portion of the open side which is on the opposite side from the folded side of the sheet bundle on which the above-described saddle-stitching processing and two-folding processing is performed.

First, the image forming device sends a sheet on which an image is formed to the sheet processing device. A sheet which is to seal a sheet bundle with saddle-stitch binding is selected as a large sheet, which is of a size larger than the other sheets, by the controller 20 of the image forming device shown in FIG. 1. The large sheet which is to seal the sheet bundle can be selected from either the image forming device or the inserter 900. The sheets which are sent to the sheet processing device pass the sheet transportation path within the device, and are transported from the direction of the arrow of the upper portion of FIG. 11A. Depending on whether the sheets are a large sheet S1 for sealing the sheet bundle or an other sheet S2 which is of a smaller size than the large sheet S1, which comprise the sheet bundle main body, the transportation direction thereof is switched by the flapper 3001.

As shown in FIG. 11A, the sheets are separated, the large sheet S1 which processes the sheet bundle to the side of the second abutter 3007, and the other sheets S2 which comprise the sheet bundle main body to the side of the first abutter 3006. The separated sheets S1 and S2 abut and stop at the abutters 3006 and 3007 of which the positions differ. When all of the sheets to be subjected to saddle-stitching are abutted against the abutters 3006 and 3007 and are aligned, the approximate center of the sheet bundle is stapled by the stapler units 3002 and 3003 (FIG. 11A).

Next, the abutters 3006 and 3007 move downward to provide the two-fold processing of the sheet bundle which has been saddle-stitched. Then the sheet bundle which moves downward along with the abutters 3006 and 3007 is pushed in the direction of the folding roller pair 3005 by the folding rod 3004 for folding the sheet bundle in half in the state wherein the edge portions S1*b* and S1*a* of the large sheet protrude approximately the same amount from the edge portions of the sheets S2, and the entire sheet bundle is gripped and transported by the folding roller pair 3005, and folded in half (FIG. 11B).

The sheet bundle which is folded in half is gripped and transported by the roller pair 827 on the downstream side, and the trailing edge (the protrusions S1*b* and S1*a* of the large sheet) thereof passes through the folding roller pair 3005 and advances to a predetermined position (stapler units 3009, 3010). When the trailing edge of the sheet bundle advances to the predetermined position, stapling processing of the one edge portion S1*b* and the other edge portion S1*a* of the large sheet S1 is performed by the staplers 3009 and 3010. Thus, the edge portion on the open side of the sheet bundle is sealed (FIG. 12).

After this, the sheet bundle on which sealing processing is performed using the edge portions S1*b* and S1*a* of the large sheet S1 is discharged into the discharge tray by the roller pair 827.

Thus, a sheet bundle (output bundle) discharged onto the discharge tray cannot be open easily by a third party, and the information therein can be shielded.

As described above, according to the present embodiment, the edge portions of the sheet bundle is sealed, using the edge portions S1*b* and S1*a* of the large sheet S1 which protrude from the edge portions S2*b* and S2*a* of the other sheets S2 of the sheet bundle, and the sheet bundle (output bundle) discharged onto the discharge tray cannot be open easily by a third party, and the information therein can be shielded. Also, the seal on the sheet bundle is only on the protruding edge portions S1*b* and S1*a* of the large sheet, and therefore even when the sheet bundle is opened, the edge portions on the open side of the other sheets S2 which forms the sheet bundle main body is not damaged, and damage to the sheet bundle can be minimized.

Sixth Exemplary Embodiment

A sheet processing device relating to a sixth exemplary embodiment will be described. The sheet processing device relating to the present embodiment will be described with reference to FIGS. 10 through 12 employed with the fifth exemplary embodiment. Also, the overall configuration of the sheet processing device is similar to the above-described embodiment, and so detailed description thereof will be omitted.

The sheet processing device relating to the present embodiment is configured so as to adhere the protrusions S1*b* and S1*a* of the large sheet S1, rather than to staple the protrusions S1*b* and S1*a* of the large sheet S1 as in the above-described fifth exemplary embodiment. In other words, with the present embodiment, the processing unit which seals the edge portion of the sheet bundle has a gluing device 3008 for adhering the one edge portion S1*b* and the other edge portion S1*a* which protrude form the large sheet S1, as shown in FIG. 10. The present embodiment illustrates the case where the gluing device 3008 is arranged on the side of the one edge portion S1*b* of the large sheet S1.

Here, the process of sealing the edge portions on the open side of the sheet bundle will be described, using the protruding edge portions S1*b* and S1*a* of the large sheet which protrude from the edge portions on the open side which is opposite the side of the folding side of the sheet bundle. The processing procedures up to the approximate center of the sheet bundle being stapled with the stapler units 3002 and 3003, and having two-fold processing and moving downward, are the same as with the above-describe embodiment, and so the description thereof is omitted here.

The sheet bundle which moves downward with the abutters 3006 and 3007 have one edge portion S1*b* of the large sheet S1 of the sheet bundle glued by the gluing device 3008 as shown in FIG. 11A.

Then, the glued sheet bundle is pushed in the direction of the folding roller pair 3005 by the folding rod 3004 for folding the sheet bundle in half, as shown in FIG. 11B, and then is gripped and transported by the folding roller pair 3005, and the entire sheet bundle is folded in half. Simultaneously, the sheet bundle has the protruding edge portions S1*b* and S1*a* of the large sheet S1 adhered by having the trailing edge thereof (the protruding edge portions S1*b* and S1*a* of the large sheet) gripped by the folding roller pair 1006.

The sheet bundle which has been folded in half and the edge portions adhered is discharged into a discharge tray by the downstream side roller pair 827. At this time, the adhered portion (the protrusions S1*a* and S1*b*) of the large sheet S1 is gripped by the roller pair 827, and thus, the adhered portion of the sheet bundle will have the gluing strengthened.

As described above, according to the present embodiment also, as with the above-described fifth embodiment, the edge portions of the sheet bundle are sealed, using the edge portions S1*b* and S1*a* of the large sheet S1 which protrude from the edge portions S2*b* and S2*a* of the other sheets S2 of the sheet bundle, and a sheet bundle (output bundle) discharged onto the discharge tray cannot be easily seen by a third party, and the information therein can be shielded. Also, the seal on the sheet bundle is only on the protruding edge portions S1*b* and S1*a* of the large sheet, and therefore even when the sheet bundle is opened, the edge portions on the open side of the other sheets S2 which forms the sheet bundle main body is not damaged, and damage to the sheet bundle can be minimized.

With the above-described sixth exemplary embodiment, the processing unit which seals the edge portion of the sheet bundle is shown with the example of a stapler units 3009 and 3010 which staples the protruding edge portions S1*b* and S1*a* of the large sheet S1, or the gluing device 3008 for adhering the protruding edge portions S1*b* and S1*a* of the large sheet S1, the present invention is not limited to these, and can have a sheet processing device which has the two processing units, and the two processing units can be selectively used.

Seventh Exemplary Embodiment

A sheet processing device relating to a seventh exemplary embodiment will be described with reference to FIG. 13 which is cross-sectional diagram showing details of the portion of a sheet processing device relating to the present embodiment. The overall configuration of the sheet processing device is the similar to the above-described embodiment, and so detailed description thereof will be omitted.

Figure 13:
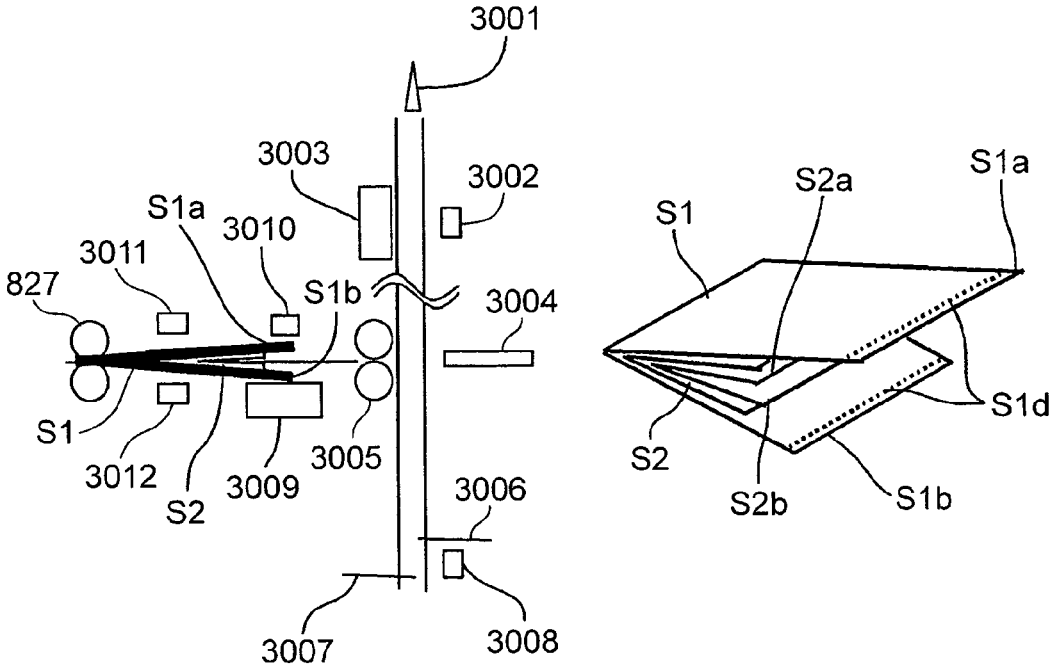
FIG. 13 is a cross-sectional diagram illustrating exemplary details of a sheet processing device relating to a seventh embodiment.

As shown in FIG. 13, the sheet processing device relating to the present embodiment has cutters 3011 and 3012 which add perforations S1*d* on the protruding edge portions S1*b* and S1*a* of the large sheet S1 for the purpose of opening the sheet bundle, in additional to the configuration of the above-described fifth or sixth embodiments.

With the present embodiment, as shown in FIG. 13, a configuration is given as an example wherein perforations S1*d* are added by the cutters 3011 and 3012 as to the protrusions S1*b* and S1*a* of the large sheet S1 which is stapled or adhered, but should not be limited to this. For example, the perforations S1*d* can be added to one or both of the one edge portion S1*b* and other edge portion S1*a* of the large sheet S1 before stapling or adhering. The operations other than this operation are the same as with the above-described embodiments, and so the description thereof will be omitted here.

As described above, according to the present embodiment, perforations S1*d* are added to the protrusions S1*b* and S1*a* of the large sheet S1 which seals the sheet bundle, for the purpose of opening the sheet bundle, and so the sealed sheet bundle can be easily opened, in addition to the advantages described in the fifth or sixth exemplary embodiments. Also, damage to the sheet bundle in the event of opening the sheet bundle can be suppressed.

Eighth Exemplary Embodiment

A sheet processing device relating to an eighth exemplary embodiment will be described. The overall configuration of the sheet processing device is similar the above-described embodiment, and so detailed description thereof will be omitted.

The sheet processing device relating to the present embodiment has a configuration which can change the sheet size of the large sheet which is included in the sheet bundle, according to the thickness of the sheet bundle to be sealed, in addition to the configurations of the embodiments described above.

Conventionally, with an image forming device, the number of sheet bundles to be output and the sheet types are known when forming the images on the sheets. Thus, the approximate thickness of the sheet bundle to be output bundles can be estimated somewhat. Thus, with the present embodiment, the size of the large sheet which processes the sheet bundle can be changed according to the estimation thereof. Thus, in addition to the advantages in the above-described embodiments, not being able to process the sealing of the sheet bundle can be prevented. Further, the sheet bundle sealing processing can be maintained in a state of not being too loose or too tight.

Ninth Exemplary Embodiment

A sheet processing device relating to a ninth exemplary embodiment will be described with reference to FIG. 14 which is a perspective view schematically illustrating the sheet bundle on which processing is performed with the sheet processing device relating to the present embodiment. The overall configuration of the sheet processing device is similar to the above-described embodiment, and so detailed description thereof will be omitted.

As mentioned before, one of the reasons for processing the sheet bundle is to shield the information within the sheet bundle from a third party. Therefore, if the large sheet which processes the sheet bundle is a sheet on which no image is formed, or a thin sheet through which the inside can be seen, problems may be anticipated such as (1) in the case a large number of sheet bundles are output, the sheet bundle cannot be distinguished from the sheet bundle of another user, and (2) a white sheet allows the information inside to be seen through.

Thus, with the sheet processing device relating to the present embodiment, the following measures are taken as to the problems in (1) and (2) above.

Figure 14:
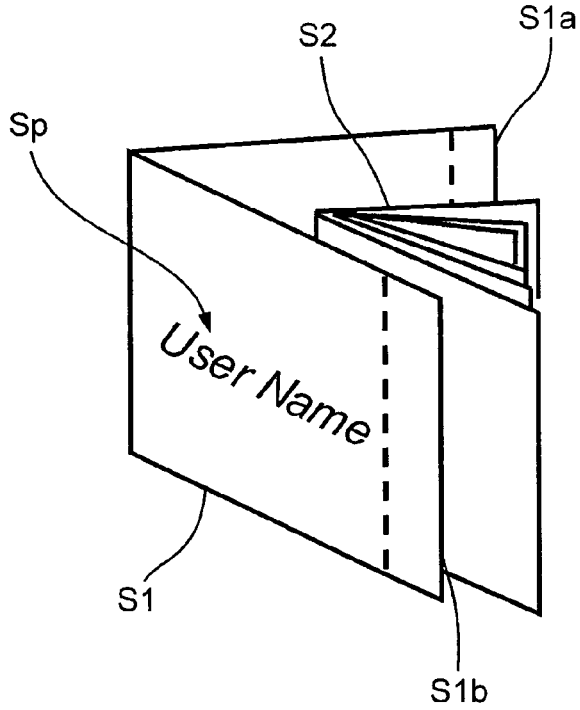
FIG. 14 is a perspective view schematically illustrating an exemplary sheet bundle on which processing is performed with the sheet processing device relating to a ninth embodiment.

First, as to the problem in (1), as shown in FIG. 14, an identifier (such as a username) Sp for each user for identifying the sheet bundle is recorded on the large sheet of the sheet bundle. Thus, in the case that a large number of sheet bundles are output, one's own sheet bundle can be easily identified from the large number of sheet bundles even when sealing processing is performed thereupon.

On the other hand, as to the problem in (2) above, a shielding image is recorded onto the large sheet of the sheet bundle, so as to shield the content within the sheet. Specifically, the inner side of the large sheet which processes the sheet bundle is colored with a color so that the content within the sheet cannot be seen through. Now, the recording of the above-described shielding image is not limited to coloring with a color which cannot be seen through, and other shielding images can be used, such as for example, a design which would prevent the content within the sheet from being determined. Thus, in the case of sealing the large sheet which processes the sheet bundle, the content thereof being seen through can be prevented.

Other Exemplary Embodiments

With the above-described first embodiment, the processing which seals the edge portion of the open side of the sheet bundle is shown as an example, using the protrusion of the large sheet which protrudes from the edge portion of the open side which is on the opposite side from the folded sided of the sheet bundle on which saddle-stitching processing and two-fold processing is performed, but the present invention is not limited to these. For example, the present invention is effectively applied to a process of sealing the edge portion of the open side of the sheet bundle wherein one edge portion is stapled by a stapler unit (edge portion stapling unit) as a bundle fastening unit. In this case, the protrusions are used of the large sheet which are protruding from the edge portion on the open side on the side opposite from the fastened side of the sheet bundle on which edge portion fastening processing is performed, and processing for sealing the open side edge portions of the sheet bundle is performed. Thus, similar advantages can be obtained as with the above-described embodiments.

Also, in the case of performing two-fold processing on the sheet bundle, a selection can be to not perform fastening processing. Performing a sealing process using the above-described large sheet with such a two-fold sheet bundle can also obtain similar advantages.

Also, the above-described first embodiment gave as an example a case of folding one place on the protrusion of the large sheet, but the present invention is not restricted to this arrangement, and two places can be folded for example, depending on the thickness of the sheet bundle,.

Also with the above-described third embodiment, the folding position of the protrusion of the large sheet by the sealing portion folding unit can be changed according to the thickness of the sheet bundle to be sealed, and the sealing portion folding unit can be moved, and the position can be moved according to the thickness of the sheet bundle to be sealed, but the present invention is not limited to this. For example, the position of the abutting member can be moved according to the thickness of the sheet bundle to be sealed, and this configuration also can obtain similar advantages.

With the above-described embodiments, the processing which seals the edge portion of the open side of the sheet bundle is shown as an example, using the protrusion of the large sheet which protrudes from the edge portion of the open side which is on the opposite side from the folded sided of the sheet bundle on which saddle-stitching processing and two-fold processing is performed, but the present invention is not limited to these. For example, the present invention is effectively applied to a process of sealing the edge portion of the open side of the sheet bundle wherein one edge portion is stapled by a stapler unit (edge portion stapling unit) as a bundle fastening unit. In this case, the protrusions are used of two large sheets which are protruding from the edge portion on the open side on the side opposite from the fastened side of the sheet bundle on which edge portion fastening processing is performed, and processing for sealing the open side edge portions of the sheet bundle is performed. Thus, similar advantages can be obtained as with the above-described embodiments.

Also with the above-described embodiment, a control unit of the image forming device is given as an example, as a controller which controls so that a large sheet of a size larger than the other sheets is selected and inserted into the sheet bundle, but should not be limited to this. For example, a configuration using a control unit for the sheet processing device can be used, or a configuration using a control unit for both can be used.

Also with the above-described embodiments, a sheet processing device which is detachable as to the image forming device is given as an example, but the present invention is not limited to this, and a sheet processing device having an image forming device as one unit can be used, and by using such a sheet processing device for the present invention, similar advantages can be obtained. Also, the image forming device can be an image forming device such as a printer, photocopier, facsimile device, or the like, or an image forming device such as a multi-function apparatus combining two or more of such functions, and by using a sheet processing device with for this image forming device for the present invention, similar advantages can be obtained.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims the benefit of Japanese Application No. 2005-173396 filed Jun. 14, 2005 and No. 2005-173397 filed Jun. 14, 2005, which are hereby incorporated by reference herein in their entirety.

What is claimed is:

1. A sheet processing device adapted to process a bundle of sheets, the bundle defined by opposing first and second bundle edges, the bundle further including a sealing sheet having a larger size than the other sheets forming the bundle, the sealing sheet including first and second sealing portions which project away from the first and second bundle edges to seal the bundle, respectively, the device comprising:

a controller which controls the device;

a sheet transporter;

a first abutting member against which the first bundle edge is abutted;

a second abutting member, provided in a position differing from that of the first abutting member, against which an edge of the first sealing portion is abutted;

a folding unit adapted to fold a bundle between the first and second bundle edges together with the sealing sheet;

a processing unit adapted to seal the folded bundle using the first and second sealing portions; and a sheet separating member adapted to separate a transported sheet from the other sheets toward either one of the first abutting or second abutting members, wherein the first and second sealing portions of the sealing sheet project away from the first and second bundle edges, respectively, when the first bundle edge abuts against the first abutting member and the first sealing portion abuts against the second abutting member, and wherein the controller switches the separating member depending on whether the transported sheet to be separated is a sheet on which an image is formed, or a sealing sheet.

2. The sheet processing device according to claim 1, wherein the processing unit staples the first and second sealing portions together.

3. The sheet processing device according to claim 1, wherein the processing unit glues the first and second sealing portions together.

4. The sheet processing device according to claim 1, further comprising a fastening unit adapted to fasten together sheets forming the bundle, wherein the folding unit folds the bundle about a fastened portion of the bundle.

5. The sheet processing device according to claim 1, wherein the controller changes the size of the sealing sheet according to the thickness of the bundle.

6. The sheet processing device according to claim 1, wherein the fastening unit is a middle fastening unit which fastens an approximate center of the bundle, wherein the folding unit is a half-fold unit which is adapted to fold the bundle in half about the fastened portion thereof.

7. An image forming device comprising:

an image forming unit adapted to form an image on a sheet; and a sheet processing device adapted to process a bundle of sheets, the bundle defined by opposing first and second bundle edges, the bundle further including a sealing sheet having a larger size than the other sheets forming the bundle, the sealing sheet including first and second sealing portions which project away from the first and second bundle edges to seal the bundle, respectively, the sheet processing device comprising:

a controller configured which controls the device;

a sheet transporter;

a first abutting member against which the first bundle edge is abutted;

a second abutting member, provided in a position differing from that of the first abutting member, against which an edge of the first sealing portion is abutted;

a folding unit adapted to fold a bundle between the first and second bundle edges together with the sealing sheet; and a processing unit adapted to seal the folded bundle using the first and second sealing portions; and a sheet separating member adapted to separate a transported sheet from the other sheets toward either one of the first abutting or second abutting members, wherein the first and second sealing portions of the sealing sheet project away from the first and the second bundle edges, respectively, when the first bundle edge abuts against the first abutting member and the first sealing portion abuts against the second abutting member, and wherein the controller switches the separating member depending on whether the transported sheet to be separated is a sheet on which an image is formed, or a sealing sheet.

8. The image forming device according to claim 7, wherein the processing unit staples the first and second sealing portions together.

9. The sheet processing device according to claim 7, wherein the processing unit glues the first and second sealing portions together.

10. The image forming device according to claim 7, further comprising a fastening unit adapted to fasten together sheets forming the bundle, wherein the folding unit folds the bundle about a fastened portion of the bundle.

11. The image forming device according to claim 7, wherein the controller changes the size of the sealing sheet according to the thickness of the bundle.

12. The image forming device according to claim 7, wherein the fastening unit is a middle fastening unit which fastens an approximate center of the bundle, wherein the folding unit is a half-fold unit which is adapted to fold the bundle in half about the fastened portion thereof.

* * * * *